US006109984A

United States Patent [19]

Tsou

[11] Patent Number: 6,109,984

[45] Date of Patent: Aug. 29, 2000

[54] TRUCK TRAILER CABLE CONNECTOR STRUCTURE

[76] Inventor: Eris Tsou, 7F, No. 56, Lane 103, Sec. 2, NeiHu Road, Taipei, Taiwan

[21] Appl. No.: 09/064,314

[22] Filed: Apr. 23, 1998

[51] Int. Cl.[7] ..... H01R 13/428

[52] U.S. Cl. ..... 439/888; 439/879

[58] Field of Search ..... 439/871, 872, 439/865, 867, 877, 879, 891, 888

[56] References Cited

U.S. PATENT DOCUMENTS

| | | | |
|---|---|---|---|
| 4,239,321 | 12/1980 | Bauer | 339/276 |
| 4,341,434 | 7/1982 | Pfister | 339/256 |
| 4,472,017 | 9/1984 | Sian | 339/217 |
| 4,701,004 | 10/1987 | Yohn | 439/871 |
| 4,913,661 | 4/1990 | Gellenthin, Jr. et al. | 439/438 |
| 5,496,968 | 3/1996 | Katoh et al. | 174/74 |
| 5,653,612 | 8/1997 | Peterson et al. | 439/745 |

*Primary Examiner*—Gary F. Paumen
*Assistant Examiner*—Truc Nguyen
*Attorney, Agent, or Firm*—Browdy and Neimark

[57] ABSTRACT

A trailer cable connector structure, particularly a plug-formed connector, includes an insulation casing having a plurality bores axially extending therethrough to each receive and fix a conductive bar therein. The casing also has a plurality of radial openings in communication with the bores. Each of the conductive bars has a first cavity and a second cavity respectively formed on two axial ends thereof, the first cavity being adapted to receive a terminal pin of a mating socket therein and the second cavity having an inner circumferential groove and being sized to receive an conductive pin therein. The conductive pin has a wire physically and electrically connected thereto. The conductive pin has a radially-projecting barb formed thereon which has an inclined surface and is elastically deformable for facilitating the insertion of the conductive pin into the second cavity of the conductive bar and to allow the barb to engage the groove in order to prevent the conductive pin from disengaging from the conductive bar. The circumferential groove is provided with a radially-extending hole aligned with the respective radial opening of the casing so as to allow a slender tool to be inserted into the second cavity for depressing and disengaging the barb from the groove. Inner threading may be provided on the radially-extending hole to engage a bolt for directly securing the wire inside the conductive bar without using the conductive pin.

4 Claims, 5 Drawing Sheets

TRUCK TRAILER CABLE CONNECTOR STRUCTURE

FIELD OF THE INVENTION

The present invention relates generally to a truck trailer connection cable which serves as an electrical interface between a tractor and a trailer and in particular to an end connector structure, such as a plug (or a socket), of the connection cable which works for both cable manufacturing factory and cable repairing workshop.

BACKGROUND OF THE INVENTION

Most of the trucks that comprise a tractor and a trailer are equipped with an electricity supply source only in the tractor and the trailer does not have an independent electricity supply. The electricity supply of the trailer is in general from the tractor and the electricity interface or connection therebetween is achieved by a cable. For ready assembly and disassembly, the trailer connection cable is usually provided with a first type end connector (such as a plug) at each of two ends thereof and correspondingly, the tractor and the trailer are each provided with a mated second type end connector (such as a socket) to which the respective first type connector is releasably engaged so that a quick electrical connection may be established/released between the tractor and the trailer. The plug and the socket are mated connectors and the term "connector", as used herein, may be generically used to refer to both the plug and the mated socket. However, a plug will be used as an example to describe the present invention herein and it is understood that the principle of the present invention is also applicable to a socket.

FIG. 1 of the attached drawings illustrates an example of conventional plug structures of the trailer connection cable, comprising an insulation casing 10 having a plurality of bores 12 extending therethrough in an axial direction. Each of the bores 12 has a slot 14 formed on an inside surface thereof and extending in the axial direction along only a portion of the bore 12, preferably from one axial end of the plug to approximately axially middle of the plug, and thus not completely axially extending through the plug casing 10. A stop shoulder 16 is formed at the inner end of the slot 14.

A tubular conductor 18 is inserted in each of the bores 12, the tubular conductor 18 having an outside diameter substantially corresponding to inside diameter of the respective bore 12 to be receivable within the bore 12. A wire 20 is fixed to each of the tubular conductors 18 with a conductive core 22 of the wire 20 in electrical and physical engagement with the tubular conductor 18. The tubular conductors 18 are provided with a barb 24 that is receivable within the slot 14 of the respective bore 12 and anchored at the stop shoulder 16 of the slot 14. The barb 24 is formed in an inclined fashion to facilitate the insertion of the tubular conductor 18 into the respective bore 12 and, once the tubular conductor 18 is inserted into the bore 12, allows the barb 24 to engage the stop shoulder 16 which prevents the tubular conductor 18 from readily separating from the bore 12.

The tubular conductor 18 has an axially extending inner through hole having a diameter sized to receive a corresponding one of a number of terminal pins of a socket (not shown in the drawings) therein when the plug is mated with the socket and the tubular conductor 18 is made elastically deformable so as to provide a tight and secure engagement between the terminal pin (not shown) and the tubular conductor 18. An electrical connection is thus established between the conductive core 22 of the wire 20 and the terminal pin of the socket.

Conventionally, the tubular conductor 18 is made of a metal sheet by means of mechanical stamping operation to form the tubular configuration so that an axial slit is present between the two lateral edges of the metal sheet that are brought to meet each other in the formation of the tubular configuration. Due to the existence of the slit, mechanical fatigue frequently occurs after numerous cycles of insertion/withdrawal of the terminal pin of the socket into/out of the tubular conductor 18. Such a mechanical fatigue may result in an un-tight engagement between the terminal pin and the tubular conductor 18 which in turn causes poor electrical engagement therebetween.

The slot 14 of each of the bores 12 is arranged to extend to an axial end. of the casing 10 to allow a slender tool, such as a screw driver, to be inserted therein to depress the barb 24 radially inward for release the engagement of the barb 24 with the stop shoulder 16 of the slot 14 and thus allowing the tubular conductor 18 to be released from the bore 12.

A disadvantage of such a structure is that the barb 24 of the tubular conductor 18 has to be precisely aligned with the slot 14 of the respective bore 12 in mounting the tubular conductor 18 in the plug so that the barb 24 is received into the slot 14 and engages the stop shoulder 16 of the slot 14 when the tubular conductor 18 is inserted into the bore 12. Thus it is quite inconvenient in mounting the tubular conductor 18 into the casing 10.

Furthermore, in case that the plug is damaged and has to be replaced, although it is possible to release the tubular conductor 18 out of the casing 10 by inserting for example a screw driver into the slot 14, a difficulty arises that since the wire 20 is securely fixed to the tubular conductor 18 by means of plastic deformation of a portion of the tubular conductor 18 which "pinches" the conductive core 22 of the wire 20 on the tubular conductor 18, separating the tubular conductor 18 from the wire 20 is not so ready as to encourage a repairperson to attempt releasing the tubular conductor 18 from the wire 20 without cutting off the wire 20. Thus, generally, in repairing a damaged plug of the trailer connection cable, a replacement plug of different structure is used which is particularly shown in FIG. 2 of the attached drawings.

As shown in FIG. 2, which illustrates a cable plug particularly designed for repair of a damaged cable, which will be referred to as "renovation plug" hereinafter, the renovation plug comprises an insulation casing 26, similarly having a plurality of axially-extending through bores 28, each having an elongated conductor 30 fixed therein. The conductor 30 has two axial ends, each having a recessed cavity 32. One of the cavities 32 has a depth sufficient to receive the insertion of a terminal pin of the socket and the other cavity 32 is sized to receive the conductive core 22 of the wire 20 from which the damaged plug (or the tubular conductor 18 of the damaged plug) has been removed. The casing 26 also has a plurality of radially-extending holes 34, each in communication with one of the axial bores 28 and the conductor 30 that is fixed inside the bore 28 is also provided with a radial hole 35 substantially aligned with the respective radial hole 34 of the casing 26. The hole 35 is in communication with the cavity 32 of the conductor 30 that receives the conductive core 22 of the wire 20 therein and has an inner threading with which a screw 36 that extends through the radial hole 34 of the casing 26 engages to secure the conductive core 22 of the wire 20 in the cavity 32 of the conductor 30, thus establishing an electrical connection between the conductor 30 and the wire 20.

Thus, the plug that is used in a cable manufacturing factory has a structure different from that is used in repairing a damaged cable in a repairing workshop. One of the reasons for such a situation is that the cable manufacturing factory needs to handle a lot of cables and thus requires high efficiency which makes it impossible to use screws to fix the wires to the plug as that is adapted in the cable repairing workshop. The fact that different plug structures are respectively used by the manufacturing factory and the repairing workshop certainly causes problems to the cable parts manufacturers and suppliers.

Therefore, it is desirable to have a trailer connection cable plug structure which suits both the needs of the cable manufacturer and the cable repairing workshops and which is capable to simplify the manufacture of the trailer connection cable.

SUMMARY OF THE INVENTION

An object of the present invention is to provide a trailer cable end connector which simplifies the manufacture of the trailer connection cable.

Another object of the present invention is to provide a trailer cable end connector and in particular a plug which may be used in both a trailer connection cable manufacturing line and a trailer connection cable repairing workshop so as to reduce the problem of the parts manufacturers in supplying two different plugs.

To achieve the above objects, in accordance with the present invention, there is provided a trailer cable connector structure and particularly a plug structure, comprising an insulation casing having a plurality bores axially extending therethrough to each receive and fix a conductive bar therein. The casing also has a plurality of radial openings in communication with the bores. Each of the conductive bars has a first cavity and a second cavity respectively formed on two axial ends thereof, the first cavity being adapted to receive a terminal pin of a mating socket therein and the second cavity having an inner circumferential groove and being sized to receive an conductive pin therein. The conductive pin has a wire physically and electrically connected thereto. The conductive pin has a radially-projecting barb formed thereon which has an inclined surface and is elastically deformable for facilitating the insertion of the conductive pin into the second cavity of the conductive bar and to allow the barb to engage the groove in order to prevent the conductive pin from disengaging from the conductive bar. The circumferential groove is provided with a radially-extending hole aligned with the respective radial opening of the casing so as to allow a slender tool to be inserted into the second cavity for depressing and disengaging the barb from the groove. Inner threading may be provided on the radially-extending hole to engage a bolt for directly securing the wire inside the conductive bar without using the conductive pin.

Conventionally, to distinguish the grounding line with other lines, the grounding terminal pin of a mating socket of the trailer connection cable plug is usually formed with a larger diameter and to accommodate such a larger grounding terminal pin of the socket, the conventional plugs, such as those shown in FIGS. 1 and 2, are provided with a large inside diameter bore which is distinguishingly designated with reference numeral 12' in FIG. 1 and 28' in FIG. 2. Under such a design, the tubular connector of the plug that is to be fixed inside the large inside diameter bore 12' (which tubular connector being designated with reference numeral 18' for distinction) has to have a larger outside diameter. This causes therefore a problem in manufacturing and assembly of the cable for one has to have two kinds of tubular connectors and has to distinguish one from the other in assembling a trailer connection cable.

Thus, an additional object of the present invention is to eliminate such the problem caused by the two different sizes of the tubular connector.

BRIEF DESCRIPTION OF THF DRAWINGS

The present invention will be better understood from the following description of a preferred embodiment thereof, with reference to the attached drawings, wherein.

DETAILED DESCRIPTION OF THE PREFERRED EMBODIMENT

Figure 3:
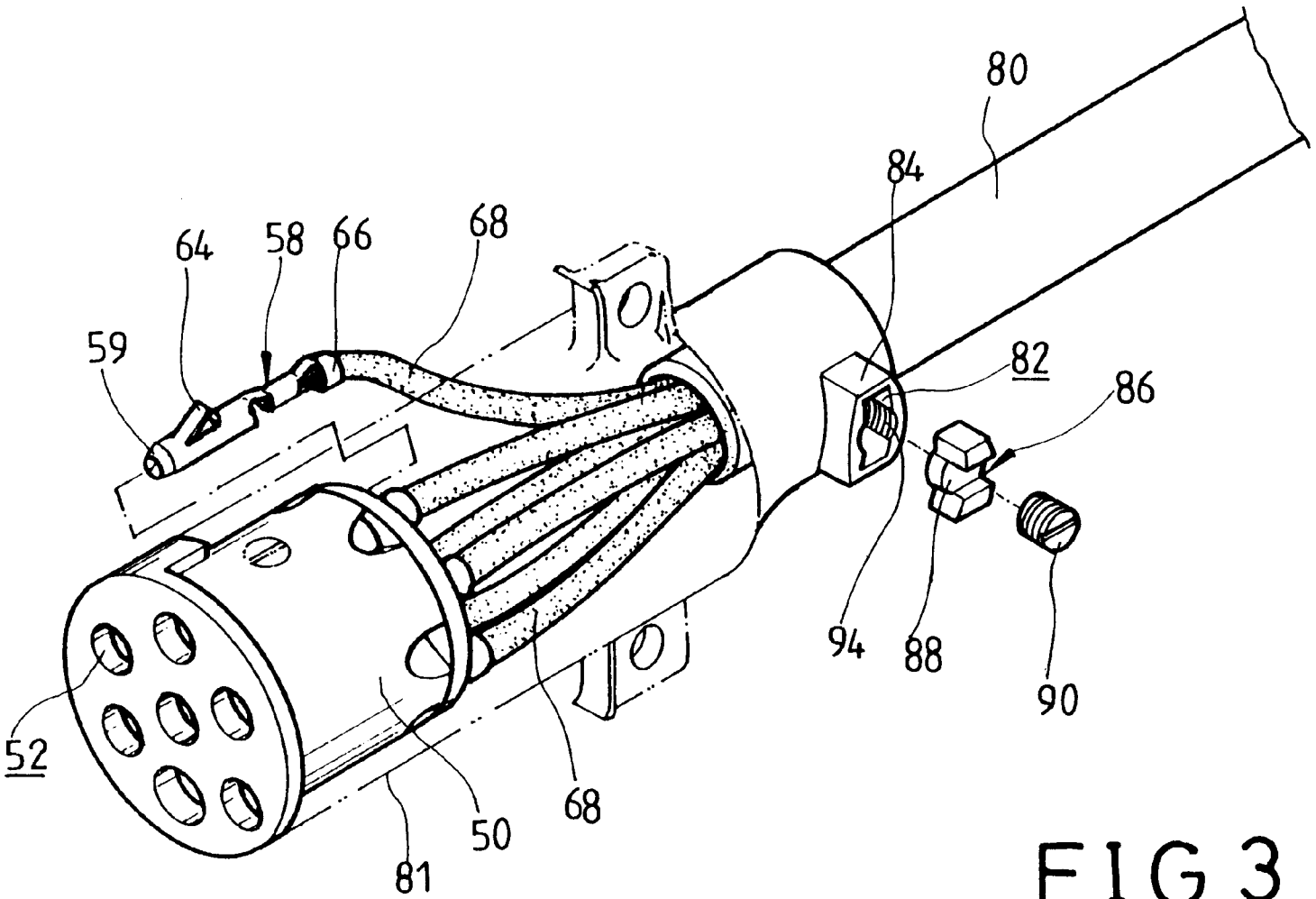
FIG. 3 is a perspective view of a trailer cable connector in accordance with the present invention, which in the illustrated embodiment is a plug, wherein a portion of the insulation housing of the plug is illustrated by phantom lines to show the inside structure thereof.
Figure 4:
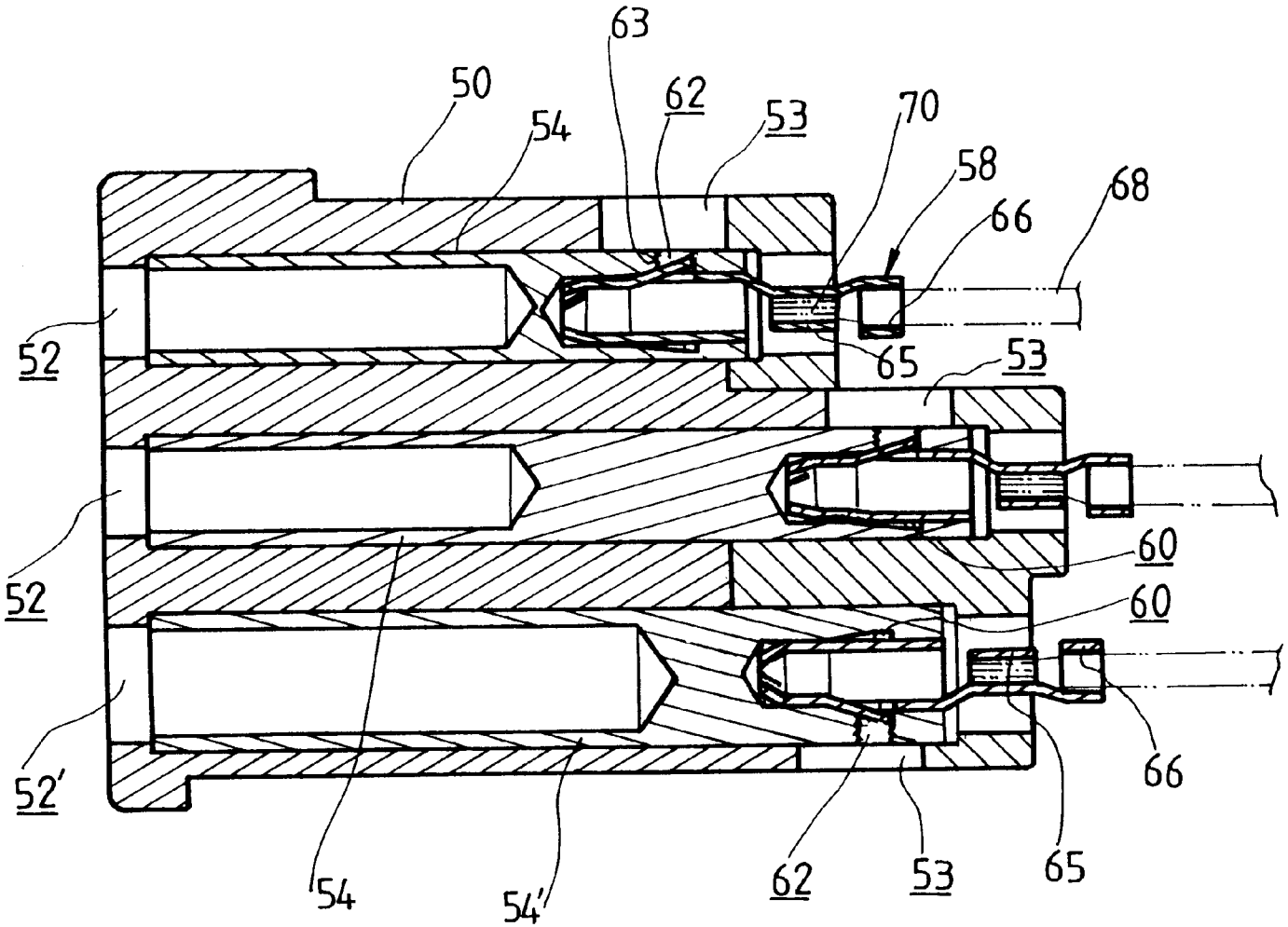
FIG. 4 is a cross-sectional view of the trailer cable plug in accordance with the present invention.

With reference to the drawings and in particular to FIGS. 3 and 4, wherein a trailer cable end connector constructed in accordance with the present invention is shown, the cable connector plug of the present invention is a plug in the embodiment illustrated, comprising a casing 50 made of an insulation material, having a plurality of axially-extending bores 52 extending therethrough of which one is particularly designated for the ground terminal pin of a mating socket (not shown) and indicated with reference numeral 52'. It should be noted that although a plug is exemplified to illustrate the present invention, the principle of the present invention is also applicable to a socket that is mated with the plug. In other words, the present invention is directed to an improvement of the connector of the trailer connection cable, including both the plug portion and the socket portion.

Figure 5:
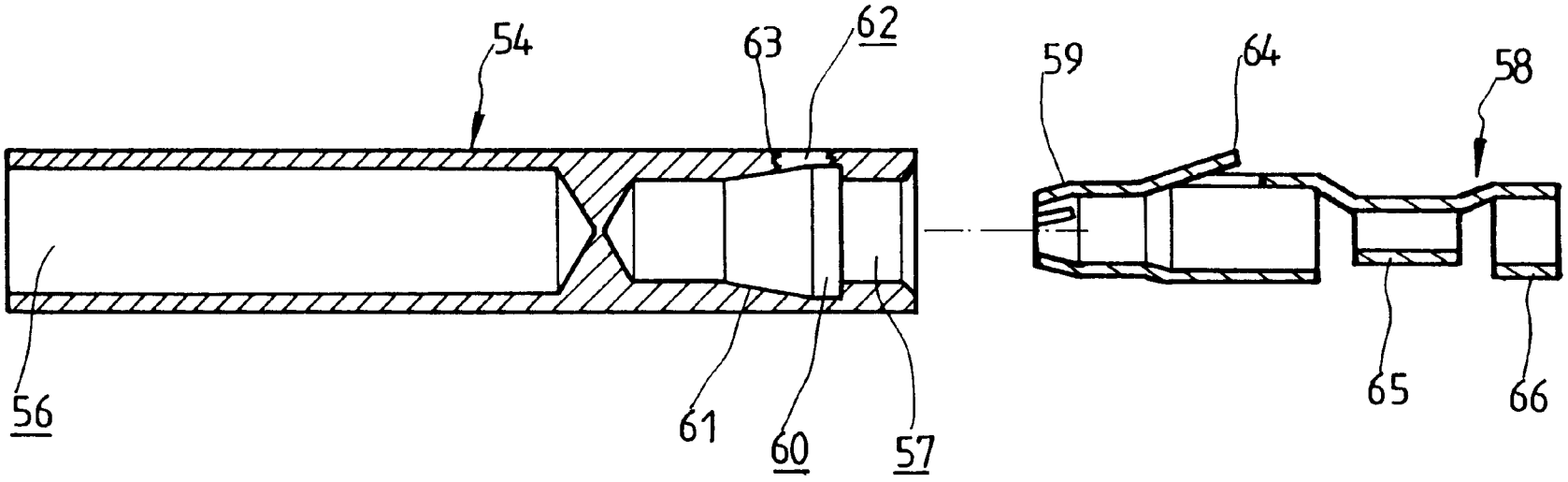
FIG 5 is an exploded, cross-sectional view of the conductive bar and the conductive pin.

The casing 50 also has a plurality of radially-extending openings 53 each communicating with a respective one of the bores 52 and 52'. Each of the bores 52 has a conductive bar 54 received and fixed therein. The conductive bar 54 has two axial ends each having a cavity 56 or 57 (see FIG. 5) in communication with two axial ends of the casing 50 respectively. The first cavity 56 is sized to receive a corresponding one of the terminal pins of the mating socket (not shown) therein, while the second cavity 57 is to receive a conductive pin 58 (to be further described) therein.

One of the conductive bars 54, which will be designated with reference numeral 54' for distinction, has a larger size to match the larger size of the bore 52' for engagement with the grounding terminal pin of the mating socket. The second cavity 57 of each of the conductive bars 54 (or 54') has a circumferential groove 60 formed on an inside surface thereof, see FIGS. 4 and 5, from which a radial hole 62 extends to be substantially aligned with and in communication with the respective radial opening 53 formed on the casing 50. The groove 60 has a first side, that is the one that is closer to the second cavity 57 of the conductive bar 54, which constitutes a plane substantially perpendicular to the axial direction of the plug so as to define a circumferential shoulder, while a second side of the groove 60 is inclined and reduced in the direction toward the first cavity 56 of the conductive bar 54 to define a truncated-conical configuration 61, see FIG. 5. In accordance with a preferred embodiment of the present invention, the radial hole 62 is provided with inner threading 63 for engagement with a bolt (not shown).

In accordance with the present invention, the second cavity 57 of the grounding conductive bar 54' is manufactured to be of the same size and shape as the second cavity 57 of the other conductive bar 54, regardless the larger size of the grounding conductive bar 54'. Thus in accordance with the present invention, there is no need to provide a particular conductive pin 58 which is particularly for the larger-sized grounding conductive bar 54' and all the conductive pins 58 would be of the same size and interchangeable. This reduces the troubles in manufacturing, assembly, warehousing and investment of the plug parts.

The conductive pin 58 is a tubular member in the embodiment illustrated which is preferably made of a metal sheet by means of mechanical stamping so as to form a tubular structure having at least slightly elastic deformability. The conductive pin 58 has a cross-sectional size and shape that correspond to the second cavity 57 of the conductive bar 54 so as to be receivable therein. Preferably, the cross-sectional size of the conductive pin 58 is slightly greater than that of the second cavity 57 so that when the conductive pin 58 is forcibly fit into the second cavity 57, it is squeezed and compressed inward which causes an elastic deformation, resulting in a tight engagement with the inside surface of the second cavity 57 which in turn forms a surface contact between the conductive pin 58 and the second cavity 57. This provides a good electrical engagement between the conductive pin 58 and the conductive bar 54 or 54'.

To facilitate the insertion of the conductive pin 58 into the second cavity 57 of the conductive bar 54, the conductive pin 58 is preferably provided with a tapering front end 59 which helps guiding the conductive pin 58 into the second cavity 57 of the conductive bar 54.

Each of the conductive pins 58 is provided with an external barb 64 which has a size determined in accordance with the inside diameter of the second cavity 57 and is inclined in such a way to match the truncated-conical section 61 of the groove 60 that is formed inside the second cavity 57. The barb 64 is elastically deformable so as to facilitate the insertion of the conductive pin 58 into the second cavity 57 and to engage the circumferential shoulder defined by the first side of the groove 60 after insertion for preventing the conductive pin 58 from separating from the conductive bar 54 or 54'.

Furthermore, the elastic deformability of the barb 64 of the conductive pin 58 also helps the barb 64 to tightly engage the truncated-conical section 61 of the groove 60 which enhances the electrical engagement between the conductive pin 58 and the conductive bar 54. In this respect, it is preferable that the barb 64 is inclined more outward than the truncated-conical section 61 of the groove 60 or the barb 64 has a size that is greater than the truncated-conical section 61 so that when the barb 64 is seated into the truncated-conical section 61 of the groove 60, the barb 64 is compressed and deformed to provide a tight engagement therebetween.

The conductive pin 58 is provided with a first clamping section 65 in the proximity of a rear end thereof, namely the end of the conductive pin 58 that is opposite to the front tapering end 59. The conductive pin 58 has an axial dimension so that when the conductive pin 58 is inserted into the second cavity 57 of the respective conductive bar 54 or 54', the rear end of the conductive pin 58 is left outside the conductive bar. 54. A wire 68 that has a conductive core 70 is fixed to the conductive pin 58 by having the conductive core 70 received in and clamped by the first clamping section 65 by means of plastic deformation of the first clamping section 65 to secure the conductive core 70 to the conductive pin 58 which establishes an electrical engagement between the wire 68 and the conductive pin 58. Preferably, the conductive pin 58 is provided with a second clamping section 66 which receives and secures the wire 68 at an insulation jacket of the wire 68 by means of plastic deformation of the second clamping section 66.

A common example of the trailer connection cable discussed herein comprises seven such wires 68 that are enclosed by a common insulation sheath 80, see FIG. 3. The insulation sheath 80 is secured to the insulation casing 50 of the plug by means of any known device, such as that shown in FIG. 3. The securing device shown in FIG. 3 comprises an insulation outer jacket 81 illustrated by phantom lines in FIG. 3 that is securely fit over the casing 50 and having an axial opening to allow the cable to extend therethrough so that the insulation sheath 80 of the cable extends from the axial opening of the jacket 81.

The jacket 81 is provided with a radial hole 82 extending to the interior of the jacket 81. The hole 82 is defined and surrounded by a wall section 84. The wall section 84 and the hole 82 defined thereby may be of any desired shape, such as rectangle as shown in FIG. 3. An anchor block 86 is radially movably received within the hole 82 with a bottom side of the anchor block 86 facing the insulation sheath 80 of the cable. The bottom side of the anchor block 86 has a contour substantially corresponding to the outer configuration of the sheath 80 of the cable so as to match each other. The anchor block 86 has a top side opposite to the bottom side and a bolt receiving recess 88 is formed on the top side to receive a tip end of a bolt 90.

The wall section 84 and/or the hole 82 is provided with inner threading 94 that engages the bolt 90 so that by rotating the bolt 90 about the threading engagement, the bolt 90 may adjust the location of the movable anchor block 86 inside the hole 82 so that the anchor block 86 may be selectively tightly pressed against the sheath 80 of the cable and thus secure the cable, including the insulation sheath 80 and the wires 68 therein, to the casing 50 of the cable plug.

In accordance with the present invention, since the conductive pin engaging groove 60 is formed circumferentially around the inside surface of the second cavity 57 of the conductive bar 54, mounting the conductive pin 58 into the second cavity 57 of the conductive bar 54 does not require to align the conductive pin 58 in a particular orientation in order to have the barb 64 of the conductive pin 58 engaging the groove 60. In dismounting, the conductive pin 58 is rotated by holding the wire 68 to have the barb 64 thereof aligned with the radial hole 62 of the conductive bar 54 and a slender article, such as a screw driver, being inserted into the radial hole 62 to depress and thus disengage the barb from the groove 62 so as to separate the conductive pin 58 out of the second cavity 57 of the conductive bar 54.

Since in general use, there is no need to repeatedly insert/withdraw the conductive pin 58 into/out of the conductive bar, the likelihood of occurrence of metal fatigue of the conductive pin 58 is greatly reduced.

In addition, in case that only the plug is damaged, but the cable is not, the conductive pin 58 may be intactly removed out of the plug by using a slender tool (not shown) and then inserted into another plug of the present invention.

Figure 1:
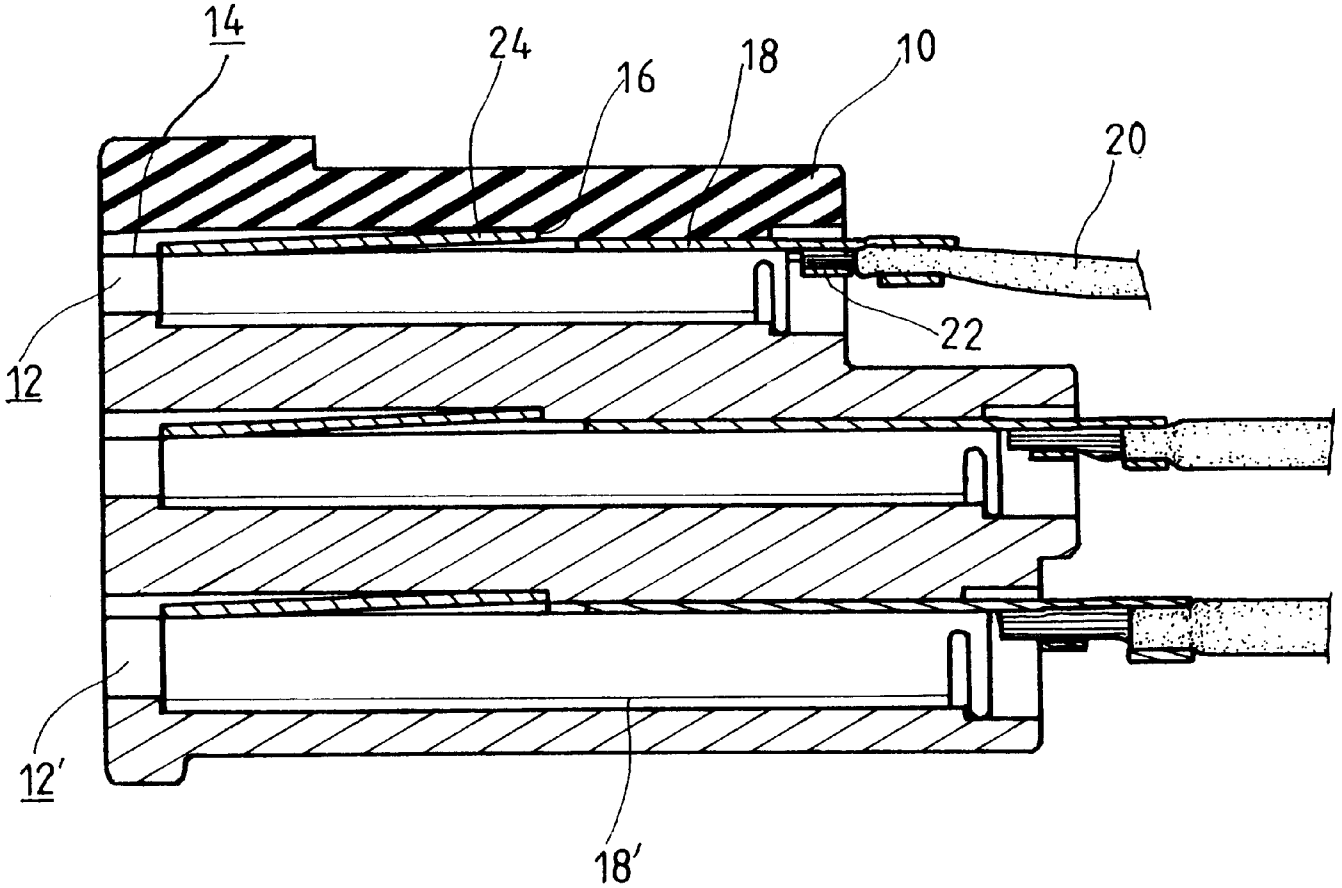
FIG.1 PRIOR ART
FIG. 1 is a cross-sectional view showing a conventional trailer connection cable plug.
Figure 2:
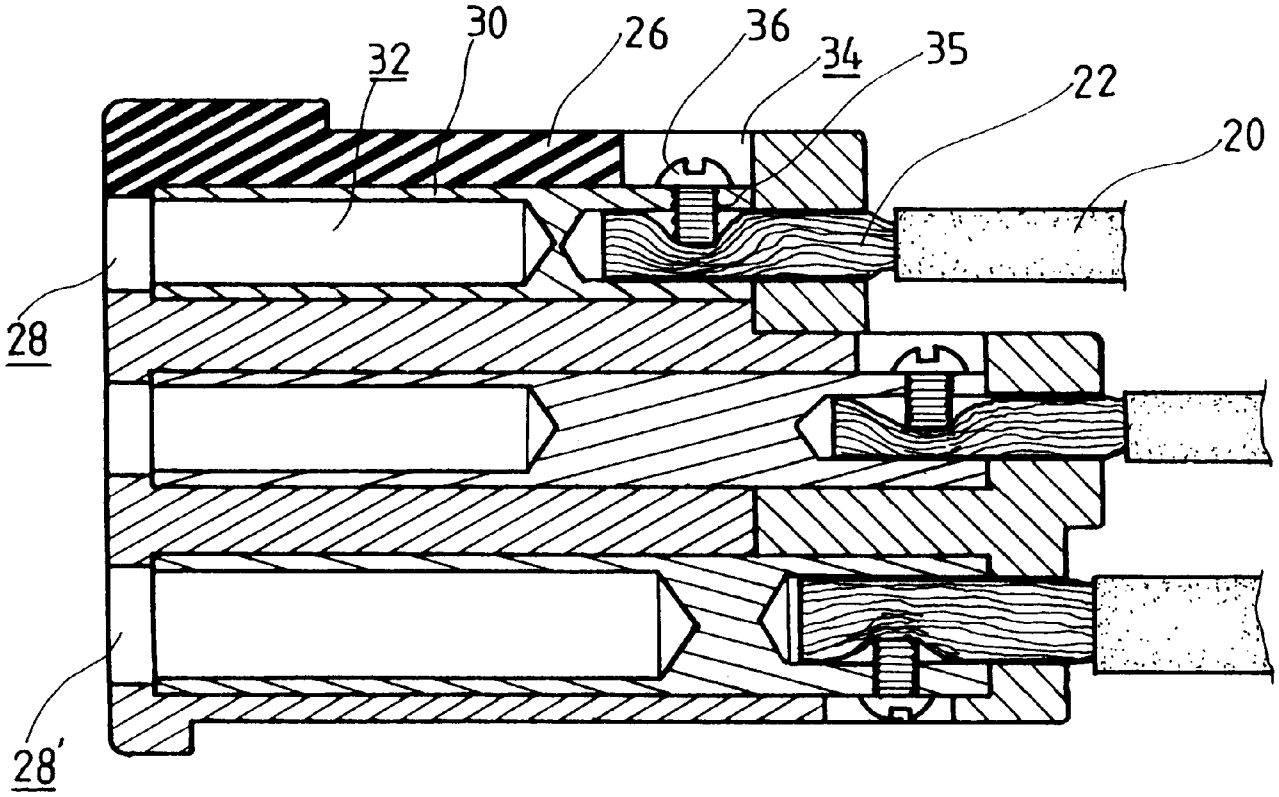
FIG. 2 PRIOR ART
FIG. 2 is a cross-sectional view showing another conventional trailer connection cable plug (the renovation plug) which is particularly for replacing a damaged plug in a repairing workshop.

Alternatively, in case that the plug is damaged to such an extent that it is not possible to intactly withdraw the conductive pin 58, one may simply cut off the wire 68 to separate the wire 68 from the plug and then expose and insert the conductive core 70 of the wire 68 into a new plug of the present invention. A bolt (not shown) is then tightened in the inner threading 63 of the radial hole 62 to secure the conductive core 70 of the wire 68 to the conductive bar 54 and establish an electrical engagement between the conductive core 70 of the wire 68 and the conductive bar 54. It should be noted that in this case that the conductive core 70 of the wire 68 is fixed to the conductive bar 54 by means of a bolt, the conventional plug (renovation plug) that is shown in FIG. 2 may be adapted to replace the plug of the present invention.

On the other hand, if only the cable is damaged, but the plug is not, then a slender tool may be used to separate the conductive pin 58 from the plug and the plug may be re-used by for example inserting another conductive pin having a wire attached thereto into the plug or alternatively, by inserting the conductive core 70 of a wire 68 into the conductive bar 54 of the plug and securing the conductive core 70 to the conductive bar 54 by means of a bolt in which case the plug of the present invention serves as renovation plug.

Thus, in view of the above description of the preferred embodiment of the present invention, the present invention provides a trailer connection cable plug structure which is capable to be used both in a cable manufacturing line and in a cable repairing workshop so that the trouble of the parts manufacturer in supplying different plugs to the cable manufacturer and the cable repair workshop is overcome. Furthermore, as discussed above, the cable plug structure of the present invention simplifies the manufacture of the trailer connection cable.

As mentioned previously, the present invention may be embodied in both a plug and a socket. The plug in accordance with the present invention has been discussed above. For a socket in accordance with the present invention, the first cavity of the conductive bar (reference numeral 54 above) of the plug may be simply eliminated and provided with a pin-like projection for insertion into the first cavity of the conductive bar of the plug. Or alternatively, a pin may be inserted into the first cavity of the conductive bar to serve as the pin-like projection. This is only a matter of design and manufacture so that there is no need to recite the structure discussed above for a socket in accordance with the present invention.

Although a preferred embodiment has been described to illustrate the present invention, it is apparent that changes and modifications in the specifically described embodiment can be carried out without departing from the scope of the invention which is intended to be limited only by the appended claims.

What is claimed is:

1. A trailer cable connector structure comprising:

an insulation casing having a plurality of bores extending in an axial direction and completely through the casing;

a plurality of conductive bars respectively fixed inside each of the bores, each of the conductive bars having a first and a second axial ends with a first cavity and a second cavity formed thereon, the first cavity being adapted to engage a corresponding portion of a mating connector and the second cavity having an inside surface on which a circumferential groove having an inclined side is formed; and a plurality of conductive pins respectively received within the second cavity of each of the conductive bars, each of the conductive pins having wire securing means to secure a wire thereto and establish electrical connection with the wire, each of the conductive pins having a radially projecting barb having an inclined surface and being elastically deformable to facilitate insertion respective into the second cavity of the respective conductive bar for establishing a surface contact therebetween and to allow the barb to engage the circumferential groove after the insertion to prevent the conductive pin from disengaging from the conductive bar, the inclined surface of the barb being engaged by the inclined side of the circumferential groove to further provide a surface contact between the conductive pin and the second cavity of the conductive bar.

2. The trailer cable connector structure as claimed in claim 1, wherein the insulation casing has a plurality of radial openings respectively communicating each of the bores and wherein the circumferential groove of each of the conductive bars has a radial hole extending in a radial direction therefrom to be substantially aligned with the respective radial opening of the insulation casing adapted to receive a slender tool to insert into the second cavity of the conductive bar for depressing and disengaging the barb from the circumferential groove and thus allowing the conductive pin to be separated from the conductive bar.

3. The trailer cable connector structure as claimed in claim 2, wherein the hole that radially extends from the circumferential groove of the second cavity of each of the conductive bars comprises an inner threading adapted to engage a bolt.

4. The trailer cable connector structure as claimed in claim 1, wherein the trailer cable connector is made in the form of a plug adapted to be received in and engaged with a socket-formed mating connector.

* * * * *